United States Patent [19]

Scherling

[11] 4,229,000

[45] Oct. 21, 1980

[54] TRAPEZE FIXTURE

[76] Inventor: J. Daniel Scherling, 4431 Ocean View, Apt. 8, Montrose, Calif. 91020

[21] Appl. No.: 40,509

[22] Filed: May 21, 1979

[51] Int. Cl.[3] ..... A63B 7/02

[52] U.S. Cl. ..... 272/61

[58] Field of Search ..... 272/52, 54, 55, 85–91, 272/61–63, 93, 109–113; 4/172; 9/310 R; 248/163–173

[56] References Cited

U.S. PATENT DOCUMENTS

| | | | |
|---|---|---|---|
| 616,697 | 12/1898 | Cowles et al. | 272/55 X |
| 1,731,532 | 10/1929 | Hoppes | 272/85 |
| 2,944,815 | 7/1960 | Moyer | 272/61 X |
| 3,117,760 | 1/1964 | Dresbach et al. | 272/61 X |
| 3,521,848 | 7/1970 | Aase | 272/61 X |
| 3,563,539 | 2/1971 | Rogers et al. | 272/61 X |
| 3,598,406 | 8/1971 | Robinson | 272/61 |
| 3,734,494 | 5/1973 | Sellner | 272/85 X |
| 3,778,054 | 12/1973 | Esposito | 272/109 X |

*Primary Examiner*—Richard J. Apley

[57] ABSTRACT

An adjustable knock-down type pool side trapeze fixture is made up of a base with spaced parallel side structures each having a telescoping main column extending obliquely upwardly and outwardly over the pool. A trapeze sling is suspended from the tops of the main columns. A stiff brace extends rearwardly from a forward end of each side of the base and is anchored to the respective main column, the columns also serving as mountings for adjustable rings and the braces being employed as a platform by the user for starting a trapeze swing. Guy lines from the main column to the base complete the bracing.

10 Claims, 3 Drawing Figures

TRAPEZE FIXTURE

For diversion in the use of swimming pools and especially home swimming pools, the most common piece of auxiliary equipment has been a diving board. Because most home pools are relatively small, a diving board must be of a modified type to confine diving to that part of the pool where the water is deep enough and to minimize as much as possible injuries to inexperienced users.

Among other fixtures popular in home type pools have been slides of various heights, usually lubricated with a stream of water, the slide having the lower discharge end protruding out into the water of the pool.

Because of the relatively small size of home pools, there is a practical limit to the number of fixtures of the general character mentioned which might be employed without having users run the risk of collision should more than one fixture be used at one time for ejecting the users into the pool.

Another factor influencing the selection of such fixtures is stability while in use. Diving boards, of course, are anchored to the pool deck so that they are immovable at all times. Chutes and slides may be provided with a base of such size and weight as to be useable merely by having it rest on the pool deck, but are such that anchoring means may also be preferable.

Heretofore, little attention or creativity has been directed to other types of playtime fixtures such as, for example, a swing featuring a bar or rings which enable the user to swing himself out over the water surface before letting loose. Because of the pendulum type use to which such a trapeze fixture is put, stability becomes a problem. Also because the user may be swinging over the water only part of the time, there can be a hazard such as might result in the user letting loose of the fixture when over the pool deck rather than over water.

It is, therefore, among the objects of the invention to provide a new and improved trapeze fixture especially adaptable for use with a swimming pool, the fixture being so arranged that for most of the swing pattern, the user is safely suspended over the water surface.

Another object of the invention is to provide a new and improved trapeze fixture for use in connection with swimming pools wherein despite a considerable tilt to those members which support a trapeze swing, there is abundant stability at the base for anchoring the fixture at a desired location.

Still another object of the invention is to provide a new and improved trapeze fixture for home type swimming pools of such construction that, if desired, the fixture can be set up in a position straddling a conventional diving board, thereby to minimize the amount of deck space devoted to the fixture.

Still another object of the invention is to provide a new and improved trapeze fixture for home type swimming pool installations which is of the knock-down type such that the members can be separated and packed for shipment and delivery in a container, the length of which is only a fraction of that of the fixture when the fixture is assembled for use.

Still another object of the invention is to provide a new and improved trapeze fixture for locations such as home type swimming pools which is adjustable as to its height and also adjustable to accommodate users of different ages and athletic ability.

Still further among the objects of the invention is to provide a new and improved knock-down type trapeze fixture, the parts of which are relatively simple in construction and assembly as well as being adjustable so that although the fixture may be purchased in a completely knocked-down condition, the average pool owner is capable, by following simple directions, to erect and install the fixture without need for especially skilled help.

Still further among the objects of the invention is to provide a new and improved trapeze fixture for home type swimming pools which is adjustable to varying heights when erected and which has one or more adjustable rungs serving as a platform so that the user, depending on his skill and ability, can stand at rest at different heights or distance locations with respect to the apex of the swing, such position being one of substantially minimum risk for the fixture swing as it is swung out over the surface of the water.

With these and other objects in view, the invention consists in the construction, arrangement and combination of the various parts of the device serving as an example only of one or more embodiments of the invention, whereby the objects contemplated are attained, as hereinafter disclosed in the specification and drawings, and pointed out in the appended claims.

Figure 2:
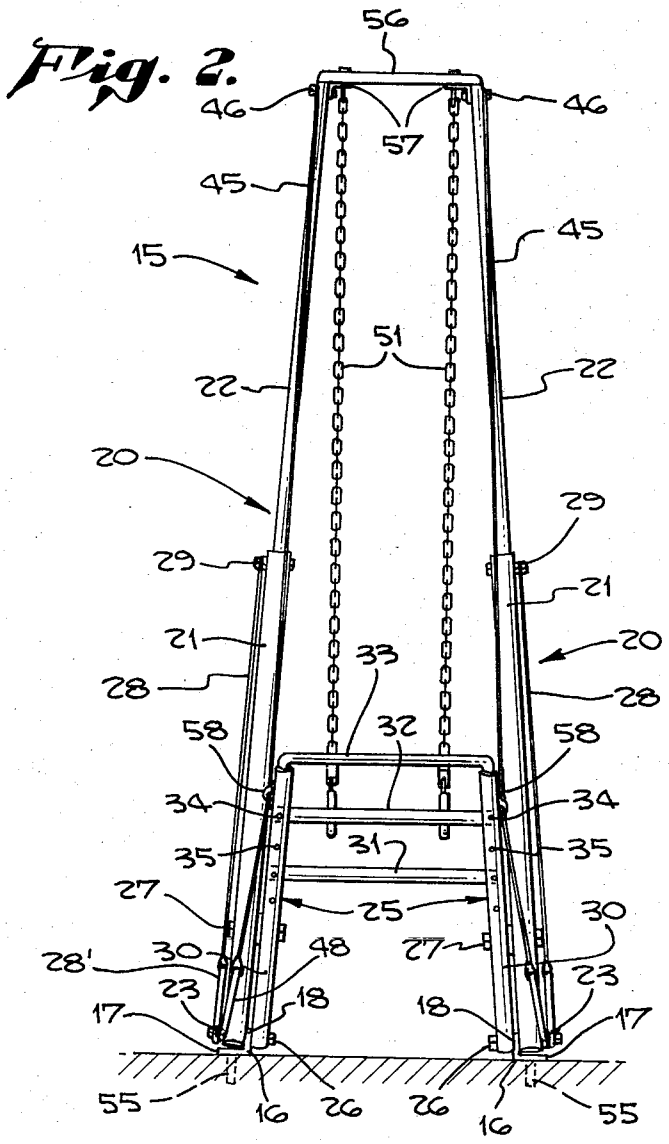
FIG. 2 is a front elevational view.
Figure 3:
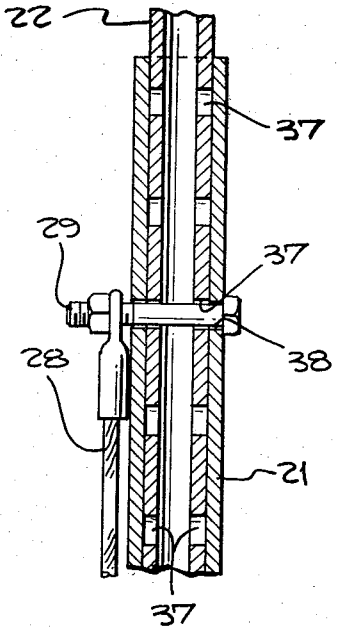
FIG. 3 is a fragmentary sectional view on the line 3—3 of FIG. 1.
Figure 1:
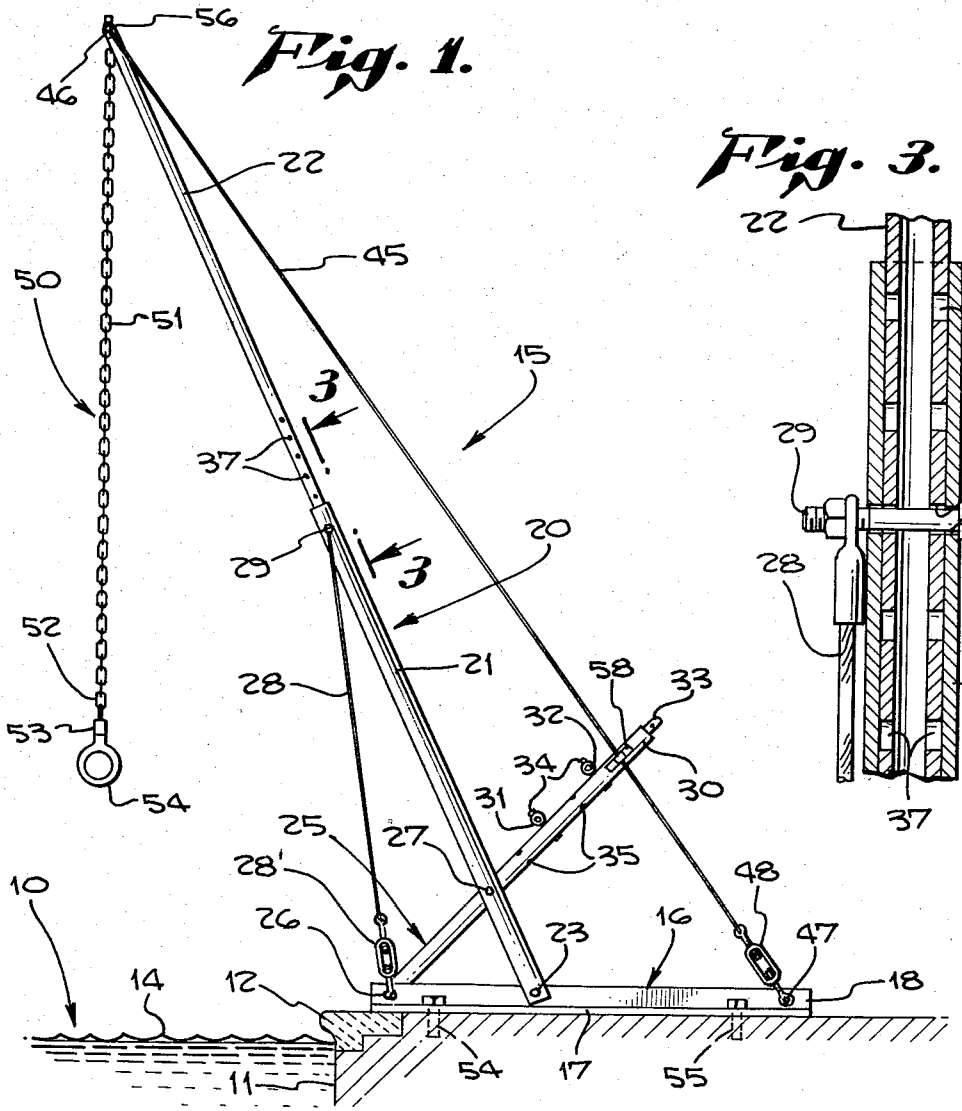
FIG. 1 is a side elevational view of the trapeze fixture shown in the position it would have at the edge of a swimming pool.

In an embodiment of the invention chosen for the purpose of illustration, there is indicated a conventional swimming pool 10 confined in part by a side wall 11, above which is a coping 12 at the edge of the side wall and a pool deck surface 13. The surface of the water is indicated at 14.

The trapeze fixture indicated generally by reference character 15 employs for its base a pair of spaced parallel angle bars 16, one leg 17 of which is adapted to be applied to the top of the pool deck 13 and another leg 18 which is upstanding for attachment of other members of the fixture. There are two angle bars, one on each lateral side of the base.

Extending upwardly and obliquely forwardly of each of the angle bars 16 is a composite column 20 consisting of a lower section 21 and an upper section 22. the lower end of each lower section is bolted to an intermediate portion of the corresponding angle bar by means of a bolt 23.

For supporting the lower section 21 in proper position, there is provided a diagonal brace 25. The lower end of the diagonal brace is secured to the fore end of the respective angle bar by means of a bolt 26. At an intermediate portion of the diagonal brace, a bolt 27 secures the diagonal brace to the adjacent portion of the respective lower section 21 of the column 20. A triangular bracing system is thus provided, but with legs of the sides of the triangle extending angularly upward in their respective directions.

At the top of the lower section 21, which extends forwardly of the fore end of the angle bar 16, a guy 28 which may be a cable, rope or other flexible brace, is attached at its upper end to a lock pin 29 which is attached to the top end of the lower section 21. the lower end of the guy 28 is attached to the bolt 26, there being provided a turnbuckle 28' near the lower end.

The diagonal brace 25 has a rearward and upwardly directed extension 30, there being such an extension 30 on each side for each of the lower sections 21. The extensions 30 provide supports for a series of rungs 31, 32 and 33. The rungs are secured at outermost ends to the respective extension 30 by means of removable bolts 34 projecting through appropriate holes. If desired, there may be provided additional holes 35 at various locations in order to be able to locate the rungs in different positions to suit different purposes.

The column 20, composite in character, is of such construction that, especially where the lower and upper sections 21 and 22, respectively, are tubular, the upper section can slide telescopingly into the upper end of the lower section 21. This telescoping relationship is deliberate in that it makes it possible to retract or extend the upper section to different heights. For fastening the two sections together in the chosen relationship, holes 37 are provided in the upper section 22 in position such that they individually coincide with a hole 38 in the lower section 21 for the joint accommodation of the removable lock pin 29.

To provide additional stability to the trapeze fixture, there is an aft guy 45, the upper end of which is anchored to the top of the composite column 20, namely the top of the upper section 22, by means of an eye bolt 46. At its lower end, the aft guy 45 is attached to the aft end of the respective angle bar 16 by an appropriate clamp 47 above which is a turnbuckle 48. By this means, more or less tension can be applied to the aft guy 45 to have it serve as a suitable brace for the composite column when the trapeze fixture is in use.

Completing the fixture is a sling 50 which may take any one of a number of forms but here shown as a chain 51 anchored at the top of the upper section 22 by suitable conventional means and with a lower end 52 provided with a releasable clamp 53. Equipped as described, each of the chains 51 may be provided, if desired, with a trapeze ring 54. In the alternative, a bar (not shown) may extend from the clamp 53 of one chain 51 to the other. As still a further alternative, there may be substituted for the bar a seat for a swing (not shown). Obviously the chains 51 may be varied as to length depending upon what use the trapeze fixture may be adapted to.

It will also be clear that inasmuch as the lower section 21 of the composite column is directed forward of the base embodied in the respective angle bar 16, so also will be the top of the upper section 22 except for extending still further over the water surface 14. Accordingly the releasable clamps 53 are suspended well out over the surface of the water in normal position, as well as throughout a good portion of the swing in both directions.

Interconnecting the tops of the upper sections 22 is a spanner 56 mounted above and secured to bracket 57 at the top of each upper section.

Since there will be appreciable weight applied to the fore end of the trapeze fixture when in use, it is advisable to employ lag screws 54 and 55 to anchor each of the angle bars 16 to the pool deck 13. The lag screw attachment can of course be applied in a manner such that it can be removed when desired.

A further element in the assembly is the provision of a cable clamp 58 at the outside surface of each of the extensions 30 of the diagonal brace 25 through which the aft guy 45 extends in assembled position. When the cable clamp 58 is tightened securely against the aft guy in its final position, there is additional bracing and stability added to each of the side structures of the trapeze fixture.

Further still, by having the side structures spaced an adequate distance apart, the space provided between them, at a location below the lowermost rung 31, is sufficient to accommodate a conventional springboard so that, when desired, the trapeze fixture can be mounted so as to straddle the springboard.

Having described the invention, what is claimed as new in support of Letters Patent is as follows:

1. An adjustable trapeze fixture comprising a base, a side structure mounted on each side of the base in spaced parallel relationship, each side structure comprising a column having its lower end anchored to the base intermediate fore and aft portions of the base and extending obliquely upwardly and forwardly over said fore portion of the base, a diagonal brace having an attachment at one end to the fore portion of the base and an attachment at an intermediate point to an intermediate portion of the column, and a forward guy brace having an attachment at one end to the fore portion of the base at the other end to the upper portion of the column, a plurality of parallel rungs extending from one diagonal brace to the other whereby to serve as platforms for the user, a longitudinally adjustable extension with its lower end removably secured to the column, an aft guy brace having an anchored attachment at the upper end of the column, said aft guy brace having an adjustable connection at its lower end to the aft portion of the respective side of the base, and a trapeze sling having an attachment to the tops of the extensions.

2. An adjustable trapeze fixture as in claim 1 wherein the column has a lower section of fixed length and position and to which the fore guy brace and the diagonal brace are attached, an upper section, and a releasable longitudinally adjustable connection between the lower end of the upper section and the upper end of the lower section whereby to vary the height of the column.

3. An adjustable trapeze fixture as in claim 2 wherein the attachment at the top of the aft guy brace is at the top of the upper section of the column.

4. An adjustable trapeze fixture as in claim 1 wherein there is a clamp between an intermediate portion of each aft guy brace and the corresponding diagonal brace.

5. An adjustable trapeze fixture as in claim 1 wherein the guy braces are flexible cables.

6. An adjustable trapeze fixture as in claim 1 wherein the rungs have adjustable attachments at different locations on the diagonal braces.

7. An adjustable trapeze fixture as in claim 1 wherein said upper section of the column is at a location forward of the fore end of the base.

8. An adjustable trapeze fixture as in claim 1 wherein there is a spanner connecting the tops of the upper sections of the columns, said spanner having a length less than the width of the base where the bottoms of the lower sections have their attachments to the base.

9. An adjustable trapeze fixture as in claim 1 wherein said upper and lower sections of the column are telescopingly related tubular members.

10. An adjustable trapeze fixture as in claim 1 wherein substantially all of said attachments are releasable attachments.

* * * * *